US009524690B2

(12) United States Patent
Lim et al.

(10) Patent No.: US 9,524,690 B2
(45) Date of Patent: Dec. 20, 2016

(54) GATE DRIVING CIRCUIT AND DISPLAY APPARATUS INCLUDING THE SAME

(71) Applicant: SAMSUNG DISPLAY CO., LTD., Yongin, Gyeonggi-Do (KR)

(72) Inventors: Jae-Keun Lim, Suwon-si (KR); Ji-Sun Kim, Seoul (KR); Kyoung-Ju Shin, Hwaseong-si (KR); Chong-Chul Chai, Seoul (KR); Jong-Hee Kim, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 302 days.

(21) Appl. No.: 14/461,359

(22) Filed: Aug. 15, 2014

(65) Prior Publication Data

US 2015/0206490 A1 Jul. 23, 2015

(30) Foreign Application Priority Data

Jan. 21, 2014 (KR) ..... 10-2014-0007270

(51) Int. Cl.
*G09G 3/36* (2006.01)

(52) U.S. Cl.
CPC ..... *G09G 3/3677* (2013.01); *G09G 2320/103* (2013.01); *G09G 2330/021* (2013.01); *G09G 2340/0435* (2013.01)

(58) Field of Classification Search
CPC ..... G09G 3/3677; G09G 2320/103; G09G 2330/021;G09G 2340/0435; G09G 3/3648; G09G 2310/061; H03K 3/012
See application file for complete search history.

(56) References Cited

U.S. PATENT DOCUMENTS

| | | | |
|---|---|---|---|
| 2011/0215323 | A1 | 9/2011 | Kurokawa et al. |
| 2013/0063400 | A1 | 3/2013 | Ahn et al. |
| 2014/0092078 | A1 | 4/2014 | Yoon et al. |

FOREIGN PATENT DOCUMENTS

| | | | |
|---|---|---|---|
| JP | 2011-186451 | A | 9/2011 |
| KR | 10-2012-0124225 | A | 11/2012 |
| KR | 10-2013-0040994 | A | 4/2013 |

*Primary Examiner* — Lun-Yi Lao
*Assistant Examiner* — Jarurat Suteerawongsa
(74) *Attorney, Agent, or Firm* — Lewis Roca Rothgerber Christie LLP

(57) ABSTRACT

A gate driving circuit includes: a pull-up controller applying a carry signal of one of previous stages to a first node in response to the carry signal of the one of the previous stages; a pull-up part outputting a clock signal as an N-th gate output signal; a carry part outputting the clock signal as an N-th carry signal; a first pull-down part pulling down the signal at the first node to a second off voltage; a second pull-down part pulling down the N-th gate output signal to a first off voltage; an inverting part generating an inverting signal based on the clock signal and the second off voltage to output the inverting signal to an inverting node; and a reset part outputting a reset signal to the inverting node.

20 Claims, 6 Drawing Sheets

GATE DRIVING CIRCUIT AND DISPLAY APPARATUS INCLUDING THE SAME

CROSS-REFERENCE TO RELATED APPLICATION

This application claims priority to and the benefit of Korean Patent Application No. 10-2014-0007270, filed on Jan. 21, 2014 in the Korean Intellectual Property Office KIPO, the entire content of which is herein incorporated by reference.

BACKGROUND

1. Field

Example embodiments of the present inventive concept relate to a gate driving circuit and a display apparatus including the same.

2. Description of the Related Art

Generally, a liquid crystal display ("LCD") apparatus includes a first substrate including a pixel electrode, a second substrate including a common electrode and a liquid crystal layer positioned between the first and second substrate. An electric field is generated by voltages applied to the pixel electrode and the common electrode. By adjusting an intensity of the electric field, a transmittance of a light passing through the liquid crystal layer may be adjusted so that a desired image may be displayed.

Generally, a display apparatus includes a display panel and a panel driver. The display panel includes a plurality of gate lines and a plurality of data lines. The panel driver includes a gate driver providing gate signals to the gate lines and a data driver providing data voltages to the data lines.

When a static image is inputted, the display panel may be driven in a low frequency to decrease power consumption.

The gate driver may include a gate driving circuit including a plurality of switching elements. The switching elements may include a thin film transistor ("TFT"). A gate driving circuit may be designed for the display panel to be driven at a high frequency. Thus, when the display panel is driven in a low frequency, some of the nodes of the gate driving circuit may have a floating status, which may reduce the reliability of the gate driving circuit.

SUMMARY

Aspects of example embodiments of the present inventive concept are directed toward a gate driving circuit that may decrease power consumption of a display apparatus and/or improve the reliability of the gate driving circuit.

Aspects of example embodiments of the present inventive concept are directed toward a display apparatus including the gate driving circuit.

According to example embodiments of the present invention, a gate driving circuit includes: a pull-up control part configured to apply a carry signal of one of previous stages to a first node; a pull-up part configured to output a clock signal as an N-th gate output signal in response to a signal applied to the first node; a carry part configured to output the clock signal as an N-th carry signal in response to the signal applied to the first node; a first pull-down part configured to pull down the signal at the first node to a second off voltage in response to a carry signal of one of next stages; a second pull-down part configured to pull down the N-th gate output signal to a first off voltage in response to the carry signal of the one of the next stages; an inverting part configured to generate an inverting signal based on the clock signal and the second off voltage to output the inverting signal to an inverting node; and a reset part configured to output a reset signal to the inverting node, wherein N is a positive integer.

When input image data represents a video image, the reset signal may have a low level; and when the input image data represents a static image, the reset signal may periodically increase to a high level from the low level.

The reset signal may be commonly applied to all of stages of the gate driving circuit.

When the input image data represents the video image, a display panel may have a first driving frequency; when the input image data represents the static image, the display panel has a second driving frequency less than the first driving frequency, and a frequency of the reset signal is equal to or greater than the second driving frequency and equal to or less than the first driving frequency.

The reset part may include a reset transistor, and the reset transistor may include a control electrode and an input electrode commonly coupled to a reset terminal to which the reset signal is applied and an output electrode coupled to the inverting node.

The gate driving circuit may further include a first holding part configured to pull down the signal at the first node to the second off voltage in response to the inverting signal applied to the inverting node and the reset signal, the first holding part may include a first holding transistor and a second holding transistor coupled to each other in series, the first holding transistor may include a control electrode coupled to the inverting node, an input electrode coupled to the first node and an output electrode coupled to an input electrode of the second holding transistor, and the second holding transistor may include a control electrode coupled to the inverting node, the input electrode coupled to the output electrode of the first holding transistor, and an output electrode to which the second off voltage is applied.

The gate driving circuit may further include a second holding part configured to pull down the N-th gate output signal to the first off voltage in response to the inverting signal and the reset signal, the second holding part may include a third holding transistor, and the third holding transistor may include a control electrode coupled to the inverting node, an input electrode coupled to a terminal outputting the N-th gate output signal, and an output electrode to which the first off voltage is applied.

The gate driving circuit may further include a third holding part configured to pull down the N-th carry signal to the second off voltage in response to the inverting signal and the reset signal; the third holding part may include a fourth holding transistor, and the fourth holding transistor may include a control electrode coupled to the inverting node, an input electrode coupled to a terminal outputting the N-th carry signal, and an output electrode to which the second off voltage is applied.

The inverting part may include: a first inverting transistor and a third inverting transistor coupled to each other in series, and a second inverting transistor and a fourth inverting transistor coupled to each other in series.

The first inverting transistor may include a control electrode and an input electrode to which the clock signal is commonly applied and an output electrode coupled to a fourth electrode; the second inverting transistor may include a control electrode coupled to a fourth node, an input electrode to which the clock signal is applied and an output electrode coupled to the inverting node; the third inverting transistor may include a control electrode coupled to a terminal outputting the N-th carry signal, an input electrode coupled to the fourth node, and an output electrode to which the second off voltage is applied; and the fourth inverting transistor may include a control electrode coupled to the terminal outputting the N-th carry signal, an input electrode coupled to the inverting node, and an output electrode to which the second off voltage is applied.

The inverting signal may have a high level when the clock signal has a high level, the inverting signal may have a low level when the clock signal has a low level, and the inverting signal may have the low level when the N-th carry signal has a high level.

The gate driving circuit may further include a carry pull-down part configured to pull down the N-th carry signal to the second off voltage in response to the carry signal of one of the next stages.

According to example embodiments of the present invention, a gate driving circuit may include a pull-up control part configured to apply a carry signal of one of previous stages to a first node; a pull-up part configured to output a clock signal as an N-th gate output signal in response to a signal applied to the first node; a carry part configured to output the clock signal as an N-th carry signal in response to the signal applied to the first node; a first pull-down part configured to pull down the signal at the first node to a second off voltage in response to a carry signal of one of next stages; a second pull-down part configured to pull down the N-th gate output signal to a first off voltage in response to the carry signal of the one of the next stages; and an inverting part configured to generate an inverting signal based on the clock signal and the second off voltage to output the inverting signal to an inverting node, wherein when input image data represents a video image, the clock signal swings between a high level and a low level, wherein when the input image data represents a static image, the clock signal swings between the high level and the low level for a scanning duration and the clock signal maintains a first low level and periodically decreases to a second low level from the first low level for a non-scanning duration, and wherein N is a positive integer.

The first low level may be the first off voltage, and the second low level may be the second off voltage.

The first low level may be the second off voltage, and the second low level may be a third off voltage less than the second off voltage.

When the input image data represents the video image, a display panel may have a driving frequency of a first frequency; when the input image data represents the static image, the display panel may have the driving frequency of a second frequency less than the first frequency; and a frequency of the clock signal to decrease to the second low level in the non-scanning duration may be equal to or greater than the second frequency and equal to or less than the first frequency.

According to example embodiments of the present invention, a display apparatus includes: a display panel configured to display an image; a data driving circuit configured to apply a data voltage to the display panel; and a gate driving circuit configured to apply a gate output signal to the display panel, the gate driving circuit comprising: a pull-up control part configured to apply a carry signal of one of previous stages to a first node; a pull-up part configured to output a clock signal as an N-th gate output signal in response to a signal applied to the first node; a carry part configured to output the clock signal as an N-th carry signal in response to the signal applied to the first node; a first pull-down part configured to pull down the signal at the first node to a second off voltage in response to a carry signal of one of next stages; a second pull-down part configured to pull down the N-th gate output signal to a first off voltage in response to the carry signal of the one of the next stages; an inverting part configured to generate an inverting signal based on the clock signal and the second off voltage to output the inverting signal to an inverting node; and a reset part configured to output a reset signal to the inverting node, wherein N is a positive integer.

When input image data represents a video image, the reset signal may have a low level; and when the input image data represents a static image, the reset signal may periodically increase to a high level from the low level.

The reset signal may be commonly applied to all of stages of the gate driving circuit.

The reset part may include a reset transistor, and the reset transistor may include a control electrode and an input electrode commonly coupled to a reset terminal to which the reset signal is applied and an output electrode coupled to the inverting node.

According to example embodiments having the gate driving circuit and the display apparatus including the gate driving circuit, when the input image data represents a static image, the display panel may be driven at a low frequency to reduce power consumption of the display apparatus. In addition, when the display panel is driven at a low frequency, nodes of the gate driving circuit may be prevented or substantially prevented from having a floating status, which may improve the reliability of the gate driving circuit.

BRIEF DESCRIPTION OF THE DRAWINGS

The above and other features and aspects of the present inventive concept will become more apparent by describing in more detail example embodiments thereof, with reference to the accompanying drawings, in which.

DETAILED DESCRIPTION

Hereinafter, the present inventive concept will be explained in more detail with reference to the accompanying drawings.

Figure 1:
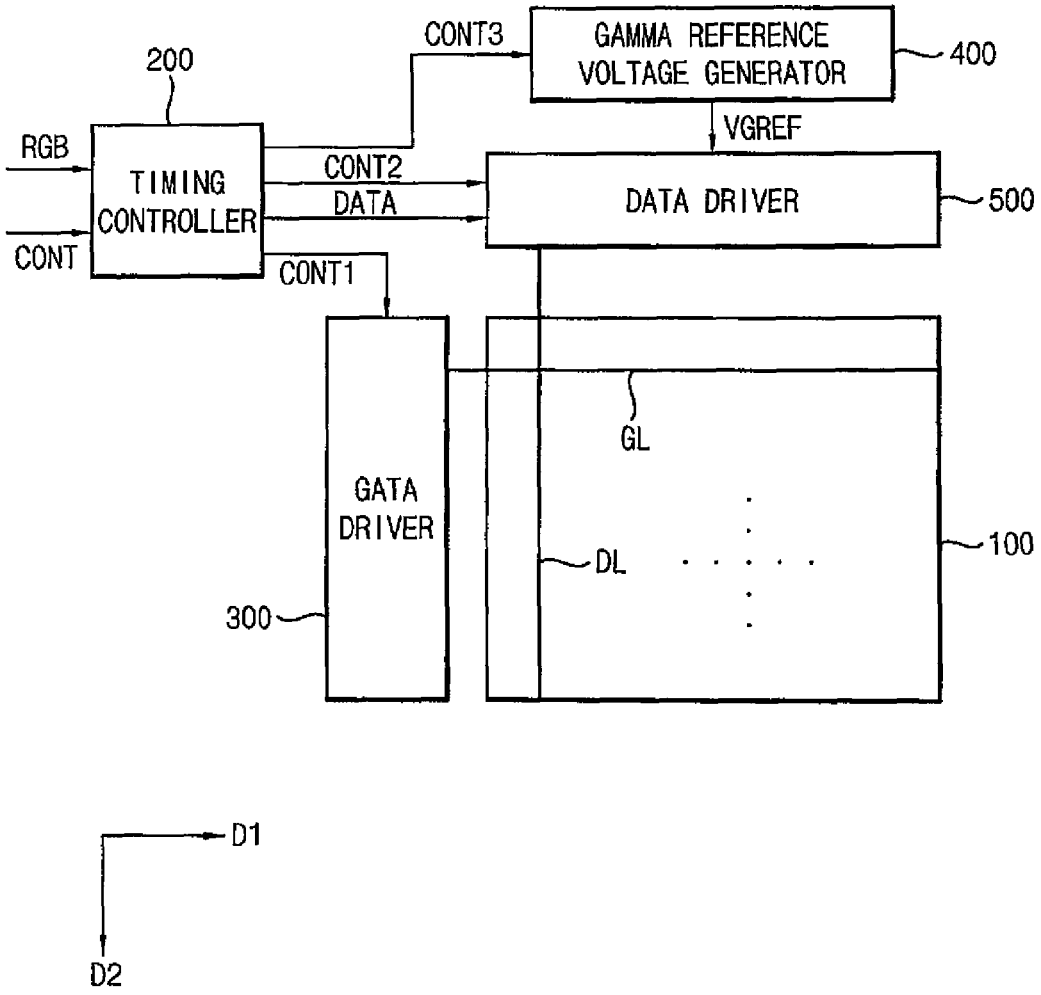
FIG. 1 is a block diagram illustrating a display apparatus according to an example embodiment of the present inventive concept.

FIG. 1 is a block diagram illustrating a display apparatus according to an example embodiment of the present inventive concept.

Referring to FIG. 1, the display apparatus includes a display panel 100 and a panel driver. The panel driver includes a timing controller 200, a gate driver 300, a gamma reference voltage generator 400, and a data driver 500.

The display panel 100 has a display region on which an image is displayed and a peripheral region adjacent to the display region.

The display panel 100 includes a plurality of gate lines GL, a plurality of data lines DL, and a plurality of unit pixels coupled to the gate lines GL and the data lines DL. The gate lines GL extend in a first direction D1, and the data lines DL extend in a second direction D2 crossing the first direction D1 (e.g., the second direction D2 being perpendicular or substantially perpendicular to the first direction D1).

Each unit pixel includes a switching element, a liquid crystal capacitor and a storage capacitor. The liquid crystal capacitor and the storage capacitor are electrically coupled to the switching element. The unit pixels may be arranged in a matrix form.

The timing controller 200 receives input image data RGB and an input control signal CONT from an external apparatus. The input image data may include red image data R, green image data G, and blue image data B. The input control signal CONT may include a master clock signal and a data enable signal. The input control signal CONT may include a vertical synchronizing signal and a horizontal synchronizing signal.

The timing controller 200 generates a first control signal CONT1, a second control signal CONT2, a third control signal CONT3, and a data signal DATA based on the input image data RGB and the input control signal CONT.

The timing controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 generates the data signal DATA based on the input image data RGB. The timing controller 200 outputs the data signal DATA to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

The timing controller 200 may determine whether the input image data RGB represents a static image or a video image.

When the input image data RGB represents a video (or non-static) image, the timing controller 200 sets a driving frequency to a first frequency. When the input image data RGB represents a static image, the timing controller 200 sets the driving frequency to a second frequency. The second frequency may be less than the first frequency. For example, the first frequency may be about 60 hertz (Hz). For example, the second frequency may be about 1 Hz.

The gate driver 300 generates gate signals driving the gate lines GL in response to the first control signal CONT1 received from the timing controller 200. The gate driver 300 sequentially outputs the gate signals to the gate lines GL.

The gate driver 300 may be directly mounted on the display panel 100, or may be coupled to the display panel 100 as a tape carrier package (TCP) configuration. Alternatively, the gate driver 300 may be integrated on the display panel 100.

Figure 2:
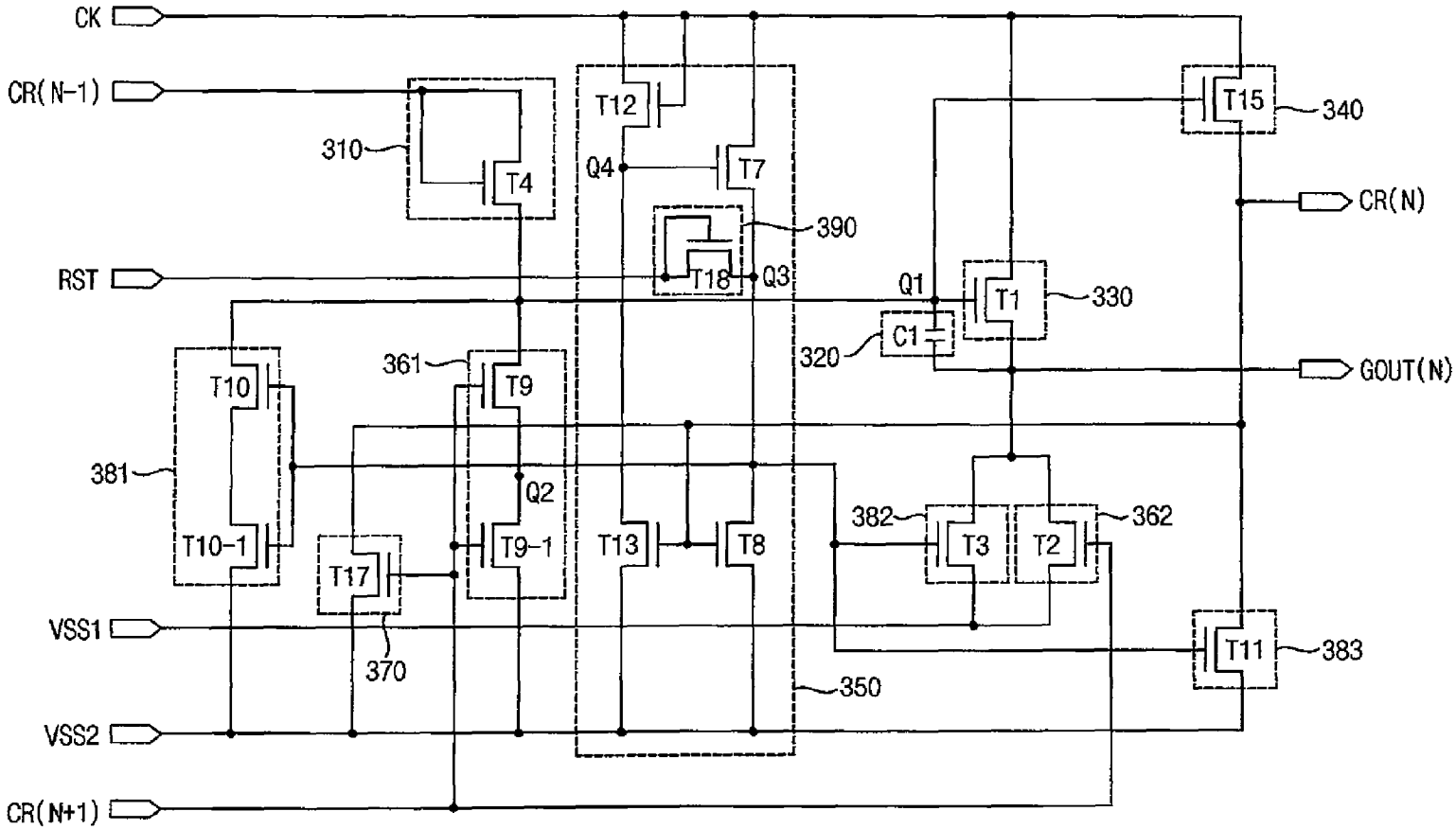
FIG. 2 is an equivalent circuit diagram illustrating an N-th stage of the gate driver of FIG. 1.

A structure of the gate driver 300 is explained in more detail referring to FIG. 2.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

In an example embodiment, the gamma reference voltage generator 400 may be located in the timing controller 200, or in the data driver 500.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages having an analog format using (or utilizing) the gamma reference voltages VGREF. The data driver 500 outputs the data voltages to the data lines DL.

The data driver 500 may be mounted (e.g., directly mounted) on the display panel 100, or be coupled to the display panel 100 in a TCP configuration. Alternatively, the data driver 500 may be integrated on the display panel 100.

Figure 3:
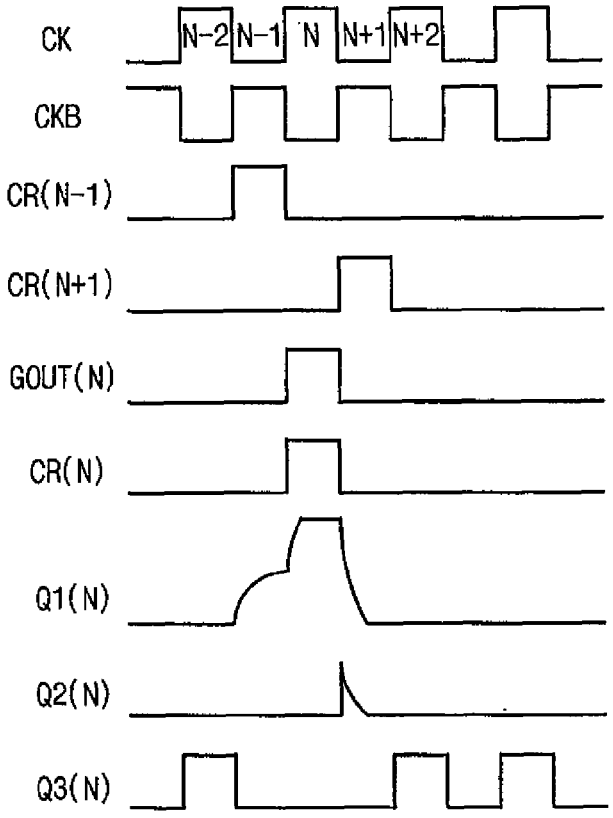
FIG. 3 is a waveform diagram illustrating input signals, node signals, and output signals of the N-th stage of the gate driver of FIG. 2.

FIG. 2 is an equivalent circuit diagram illustrating an N-th stage of the gate driver 300 of FIG. 1. FIG. 3 is a waveform diagram illustrating input signals, node signals, and output signals of the N-th stage of the gate driver 300 of FIG. 2.

Referring to FIGS. 1 to 3, the gate driver 300 receives a first clock signal CK, a second clock signal CKB, a first off voltage VSS1, a second off voltage VSS2, and a reset signal RST. The gate driver 300 outputs a gate output signal GOUT.

The first clock signal CK and the second clock signal CKB are applied to a clock terminal. The first off voltage VSS1 is applied to a first off terminal. The second off voltage VSS2 is applied to a second off terminal. The reset signal RST is applied to a reset terminal. The gate output signal GOUT is outputted from a gate output terminal.

The first clock signal CK is a square wave having a high level and a low level alternated with each other. The high level of the first clock signal CK may correspond to a gate on voltage. The low level of the first clock signal CK may correspond to the second gate off voltage VSS2. A duty ratio of the first clock signal CK may be 50%.

Alternatively, the duty ratio of the first clock signal CK may be less than 50%. The first clock signal CK may be applied to odd-numbered stages of the gate driver 300 or to even-numbered stages of the gate driver 300. For example, the gate on voltage may be between about 15V and about 20V.

The second clock signal CKB is a square wave having a high level and a low level alternated with each other. The high level of the second clock signal CKB may correspond to the gate on voltage. The low level of the second clock signal CKB may correspond to the second gate off voltage VSS2. A duty ratio of the second clock signal CKB may be 50%. Alternatively, the duty ratio of the second clock signal CKB may be less than 50%. The second clock signal CKB may be applied to odd-numbered stages of the gate driver 300 or to even-numbered stages of the gate driver 300. For example, when the first clock signal CK is applied to the odd-numbered stages of the gate driver 300, the second clock signal CKB is applied to the even-numbered stages of the gate driver 300. For example, when the first clock signal CK is applied to the even-numbered stages of the gate driver 300, the second clock signal CKB is applied to the odd-numbered stages of the gate driver 300. For example, the second clock signal CKB may be an inverting signal of the first clock signal CK.

The first off voltage VSS1 may be a direct-current ("DC") signal. The second off voltage may be a DC signal. The second off voltage may have a level lower than a level of the first off voltage VSS1. For example, the first off voltage VSS1 may be about −5V. For example, the second off voltage VSS2 may be about −10V.

The N-th stage outputs an N-th gate output signal GOUT (N) and an N-th carry signal CR(N) in response to an (N−1)-th carry signal CR(N−1) of an (N−1)-th stage, which is a previous stage of the N-th stage. The N-th stage pulls down the N-th gate output signal GOUT(N) to the first off voltage VSS1 in response to an (N+1)-th carry signal CR(N+1) of an (N+1)-th stage, which is a next stage of the N-th stage. Herein, N is a natural number.

In a similar manner, first to last stages sequentially output gate output signals GOUT.

The (N−1)-th carry signal CR(N−1) is applied to an (N−1)-th carry terminal. The (N+1)-th carry signal CR(N+1) is applied to an (N+1)-th carry terminal. The N-th carry signal CR(N) is outputted from an N-th carry terminal.

The n-th stage includes a pull-up control part (e.g., a pull-up controller or pull-up control device) 310, a charging part (or charging device) 320, a pull-up part (or a pull-up device) 330, a carry part (or carry device) 340, an inverting part (e.g., an inverter or inverting device) 350, a first pull-down part (or pull-up device) 361, a second pull-down part (or second pull-down device) 362, a carry pull-down part (or carry pull-down device) 370, a first holding part (or first holding device) 381, a second holding part (or second holding device) 382, a third holding part (or third holding device) 383, and a reset part (or reset device) 390.

The pull-up control part 310 includes a fourth transistor T4. The fourth transistor T4 includes a control electrode and an input electrode commonly coupled to the (N−1)-th carry terminal, and an output electrode coupled to a first node Q1. The first node Q1 is coupled to a control electrode of the pull-up part 330.

The charging part 320 includes a charging capacitor C1. The charging capacitor C1 includes a first electrode coupled to the first node Q1 and a second electrode coupled to the gate output terminal.

The pull-up part 330 outputs the first clock signal CK as the N-th gate output signal GOUT(N) in response to a signal applied to the first node Q1.

The pull-up part 330 includes a first transistor T1. The first transistor T1 includes a control electrode coupled to the first node Q1, an input electrode coupled to the clock terminal, and an output electrode coupled to the gate output terminal.

For example, the control electrode of the first transistor T1 may be a gate electrode. The input electrode of the first transistor T1 may be a source electrode. The output electrode of the first transistor T1 may be a drain electrode.

The carry part 340 outputs the first clock signal CK as the N-th carry signal CR(N) in response to the signal applied to the first node QI The carry part 340 includes a fifteenth transistor T15 and a fourth capacitor C4. The fifteenth transistor T15 includes a control electrode coupled to the first node Q1, an input electrode coupled to the clock terminal, and an output electrode coupled to the N-th carry terminal.

For example, the control electrode of the fifteenth transistor T15 may be a gate electrode. The input electrode of the fifteenth transistor T15 may be a source electrode. The output electrode of the fifteenth transistor T15 may be a drain electrode.

The inverting part 350 generates an inverting signal based on the first clock signal CK and the second off voltage VSS2 to output the inverting signal to a third node Q3. The third node Q3 is called as an inverting node.

The inverting part 350 includes a twelfth transistor T12, a seventh transistor T7, a thirteenth transistor T13, and an eighth transistor T8. The twelfth transistor T12 and the seventh transistor T7 are coupled to each other in series. The thirteenth transistor T13 and the eighth transistor T8 are coupled to each other in series.

The twelfth transistor T12 includes a control electrode and an input electrode commonly coupled to the clock terminal, and an output electrode coupled to a fourth node Q4. The seventh transistor T7 includes a control electrode coupled to the fourth node Q4, an input electrode coupled to the clock terminal, and an output electrode coupled to a third node Q3. The thirteenth transistor T13 includes a control electrode coupled to the N-th carry terminal, an input electrode coupled to the fourth node Q4, and an output electrode coupled to the second off terminal. The eighth transistor T8 includes a control electrode coupled to the N-th carry terminal, an input electrode coupled to the third node Q3, and an output electrode coupled to the second off terminal.

For example, the control electrodes of the twelfth, seventh, thirteenth, and eighth transistors T12, T7, T13, and T8 may be gate electrodes. The input electrode of the twelfth, seventh, thirteenth, and eighth transistors T12, T7, T13, and T8 may be source electrodes. The output electrode of the twelfth, seventh, thirteenth, and eighth transistors T12, T7, T13, and T8 may be drain electrodes.

For example, the twelfth transistor T12 may be a field relaxation transistor ("FRT") including a floating metal positioned between the drain electrode and the source electrode.

Herein, the twelfth transistor T12 is a first inverting transistor. The seventh transistor T7 is a second inverting transistor. The thirteenth transistor 113 is a third inverting transistor. The eighth transistor T8 is a fourth inverting transistor.

The first pull-down part 361 pulls down the voltage at the first node Q1 to the second off voltage VSS2 in response to the (N+1)-th carry signal CR(N+1).

The first pull-down part 361 may include a plurality of switching elements coupled to each other in series. For example, the first pull-down part 361 may include two transistors coupled to each other in series.

For example, the first pull-down part 361 includes a ninth transistor T9 and "9-1" transistor T9-1. The ninth transistor T9 includes a control electrode coupled to (N+1)-th carry terminal, an input electrode coupled to the first node Q1, and an output electrode coupled to the second node Q2. The 9-1 transistor T9-1 includes a control electrode coupled to the (N+1)-th carry terminal, the input electrode coupled to the second node Q2, and an output electrode coupled to the second off terminal.

For example, the control electrodes of the ninth and 9-1 transistors T9 and T9-1 may be gate electrodes. The input electrodes of the ninth and 9-1 transistors T9 and T9-1 may be source electrodes. The output electrodes of the ninth and 9-1 transistors T9 and T9-1 may be drain electrodes.

The first pull-down part 361 includes the transistors coupled to each other in series so that the voltage at the first node Q1 and the second off voltage VSS2 may be divided into the ninth transistor T9 and the 9-1 transistor T9-1. Thus, the reliability of the gate driver 300 may be improved and a lifetime of the gate driver 300 may increase.

Herein, the ninth transistor T9 is a first pull-down transistor. The 9-1 transistor T9-1 is a second pull-down transistor.

The second pull-down part 362 pulls down the N-th gate output signal GOUT(N) to the first off voltage VSS1 in response to the (N+1)-th carry signal CR(N+1).

The second pull-down part 362 includes the second transistor T2. The second transistor T2 includes a control electrode coupled to the (N+1)-th carry terminal, an input electrode coupled to the gate output terminal, and an output electrode coupled to the first off terminal.

For example, the control electrode of the second transistor T2 may be a gate electrode. The input electrode of the second transistor T2 may be a source electrode. The output electrode of the second transistor T2 may be a drain electrode.

The carry pull-down part 370 pulls down the N-th carry signal CR(N) to the second off voltage VSS2 in response to the (N+1)-th carry signal CR(N+1).

The carry pull-down part 370 includes a seventeenth transistor 117. The seventeenth transistor 117 includes a control electrode coupled to the (N+1)-th carry terminal, an input electrode coupled to the N-th carry terminal, and an output electrode coupled to the second off terminal.

For example, the control electrode of the seventeenth transistor T17 may be a gate electrode. The input electrode of the seventeenth transistor T17 may be a source electrode. The output electrode of the seventeenth transistor T17 may be a drain electrode.

In addition, the carry stabilizing part 370 reduces a noise due to a leakage current transmitted through a fourth transistor T4 of the (N+1)-th stage.

The first holding part 381 pulls down the voltage at the first node Q1 to the second off voltage VSS2 in response to the inverting signal applied to the third node Q3.

The first holding part 381 may include a plurality of switching elements coupled to each other in series. For example, the first holding part 381 may include two transistors coupled to each other in series.

For example, the first holding part 381 includes tenth transistor T10 and "10-1" transistor T10-1. The tenth transistor T10 includes a control electrode coupled to the third node Q3, an input electrode coupled to the first node Q1, and an output node coupled to an input node of the 10-1 transistor T10-1. The 10-1 transistor T10-1 includes a control electrode coupled to the third node Q3, the input electrode coupled to the output electrode of the tenth transistor T10, and an output electrode coupled to the second off terminal.

For example, the control electrodes of the tenth and 10-1 transistors T10 and T10-1 may be gate electrodes. The input electrodes of the tenth and 10-1 transistors T10 and T10-1 may be source electrodes. The output electrodes of the tenth and 10-1 transistors T10 and T10-1 may be drain electrodes.

The first holding part 381 includes a plurality of transistors so that the voltage at the first node Q1 and the second off voltage VSS2 may be divided into (or by) the tenth transistor T10 and the 10-1 transistor T10-1. Thus, the reliability of the gate driver 300 is improved and a lifetime of the gate driver 300 may increase.

Herein, the tenth transistor T10 is a first holding transistor. The 10-1 transistor T10-1 is a second holding transistor.

The second holding part 382 pulls down the N-th gate output signal GOUT(N) to the first off voltage VSS1 in response to the inverting signal applied to the third node Q3 and the reset signal RST.

The second holding part 382 includes a third transistor T3. The third transistor T3 includes a control electrode coupled to the third node Q3, an input electrode coupled to the gate output terminal, and an output electrode coupled to the first off terminal.

For example, the control electrode of the third transistor T3 may be a gate electrode. The input electrode of the third transistor T3 may be a source electrode. The output electrode of the third transistor T3 may be a drain electrode.

Herein, the third transistor T3 is a third holding transistor.

The third holding part 383 pulls down the N-th carry signal CR(N) to the second off voltage VSS2 in response to the inverting signal applied to the third node Q3 and the reset signal RST.

The third holding part 383 includes an eleventh transistor T11. The eleventh transistor T11 includes a control electrode coupled to the third node Q3, an input electrode coupled to the N-th carry terminal, and an output electrode coupled to the second off terminal.

For example, the control electrode of the eleventh transistor T11 may be a gate electrode. The input electrode of the eleventh transistor T11 may be a source electrode. The output electrode of the eleventh transistor T11 may be a drain electrode.

Herein, the eleventh transistor T11 is a fourth holding transistor.

The reset part 390 outputs the reset signal RST to the inverting node in response to the reset signal RST.

The reset part 390 includes an eighteenth transistor T18. The eighteenth transistor T18 includes a control electrode and an input electrode commonly coupled to the reset terminal, and an output electrode coupled to the third node Q3.

For example, the control electrode of the eighteenth transistor T18 may be a gate electrode. The input electrode of the eighteenth transistor T18 may be a source electrode. The output electrode of the eighteenth transistor T18 may be a drain electrode.

Herein, the eighteenth transistor T18 is a reset transistor.

In the present example embodiment, although the (N−1)-th carry signal is used as a previous carry signal, the previous carry signal is not limited to the (N−1)-th carry signal. The previous carry signal may be a carry signal of one of previous stages. In addition, although the (N+1)-th carry signal is used as a next carry signal, the next carry signal is not limited to the (N+1)-th carry signal. The next carry signal may be a carry signal of one of next stages.

In the present example embodiment the first, second, third, fourth, seventh, eighth, ninth, 9-1, tenth, 10-1, eleventh, twelfth, thirteenth, fifteenth, seventeenth, and eighteenth transistors may be oxide semiconductor transistors. A semiconductor layer of the oxide semiconductor transistor may include an oxide semiconductor. For example, the semiconductor layer may include at least one of a zinc oxide, a tin oxide, a gallium indium zinc (Ga—In—Zn) oxide, an indium zinc (In—Zn) oxide, a indium tin (In—Sn). oxide, indium tin zinc (In—Sn—Zn) oxide, etc. The semiconductor layer 130 may include an oxide semiconductor doped with a metal (and/or a conductive material) (such as aluminum (Al), nickel (Ni), copper (Cu), tantalum (Ta), molybdenum (Mo), hafnium (Hf), titanium (Ti), niobium (Nb), chromium (Cr), or tungsten (W)). The present invention is not limited to a material of the oxide semiconductor.

Alternatively, the first, second, third, fourth, seventh, eighth, ninth, 9-1, tenth, 10-1, eleventh, twelfth, thirteenth, fifteenth, seventeenth, and eighteenth transistors may be amorphous silicon transistors.

Referring to FIG. 3, the first clock signal CK has a high level corresponding to (N−2)-th stage, N-th stage, (N+2)-th stage and (N+4)-th stage. The second clock signal CKB has a high level corresponding to (N−1)-th stage, (N+1)-th stage and (N+3)-th stage.

The (N−1)-th carry signal CR(N−1) has a high level corresponding to the (N−1)-th stage. The (N+1)-th carry signal CR(N+1) has a high level corresponding to the (N+1)-th stage.

The gate output signal GOUT(N) of the N-th stage is synchronized with the first clock signal CK, and has a high level corresponding to the N-th stage. The N-th carry signal CR(N) is synchronized with the first clock signal CK, and has a high level corresponding to the N-th stage.

A voltage of the first node Q1 of the N-th stage is increased to a first level corresponding to the (N−1)-th stage by the pull-up control part 310. The voltage at the first node Q1 of the N-th stage is increased to a second level, which is higher than the first level, corresponding to the N-th stage by the pull-up part 330 and the charging part 320. The voltage at the first node Q1 of the N-th stage is decreased corresponding to the (N+1)-th stage by the first pull-down part 361.

A voltage at the second node Q2 of the N-th stage has a high level corresponding to the N-th stage by the first voltage adjusting part 330 and is decreased corresponding to the (N+1)-th stage by the first pull-down part 361.

A voltage at the third node Q3 of the N-th stage is synchronized with the first clock signal CK. The voltage of the third node Q3 of the N-th stage has a high level corresponding to the (N−2)-th stage, (N+2)-th stage and the (N+4)-th stage by the inverting part 350. The voltage of the third node Q3 of the N-th stage has a high level except for the N-th stage at which the gate output signal GOUT has a high level. The voltage of the third node Q3 may be an inverting signal.

Figure 4:
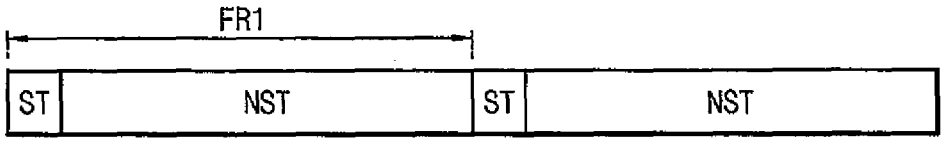
FIG. 4 is a conceptual diagram illustrating a method of driving the display panel of FIG. 1 when the input image data represents a static image.
Figure 5:
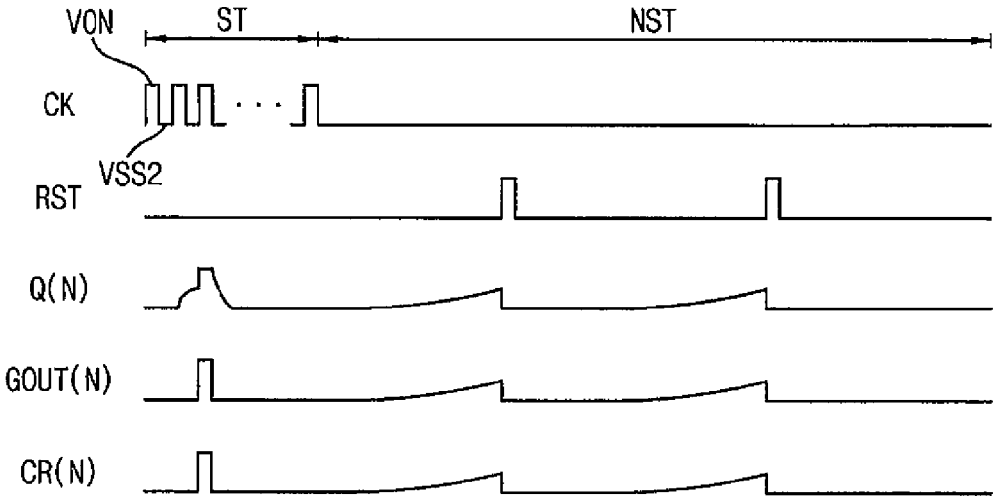
FIG. 5 is a waveform diagram illustrating input signals, node signals, and output signals of the N-th stage of the gate driver of FIG. 2 when the input image data represents a static image.

FIG. 4 is a conceptual diagram illustrating a method of driving the display panel 100 of FIG. 1 when the input image data represents a static image. FIG. 5 is a waveform diagram illustrating input signals, node signals and output signals of the N-th stage of the gate driver 300 of FIG. 2 when the input image data represents a static image.

Referring to FIGS. 1 to 5, the timing controller 200 determines whether the input image data RGB represents a static image or a video image.

When the input image RGB represents a video image, the timing controller 200 sets the driving frequency of the display panel 100 to a first frequency. When the input image RGB represents a static image, the timing controller 200 sets the driving frequency of the display panel 100 to a second frequency. The second frequency is less than the first frequency.

When the display panel 100 is driven in a high frequency, the clock signal CK and CKB swings between a high level and a low level and the gate driving circuit 300 repeats a scanning operation.

The high level of the clock signal CK and CKB may be the gate on voltage VON. The low level of the clock signal CK and CKB may be the second off voltage VSS2.

For example, when the driving frequency of the display panel 100 is about 60 Hz, the gate driving circuit 300 repeatedly generates the gate output signal GOUT corresponding to the gate lines GL based on the clock signal CK and CKB and the gate driving circuit 300 operates about sixty scanning operations during every second.

In contrast, when the display panel 100 is driven in a low frequency, the gate driving circuit 300 operates a scanning operation for a short scanning duration ST and stops scanning for a long non-scanning duration NST.

For example, when the driving frequency of the display panel 100 is about 1 Hz, the gate driving circuit 300 operates one scanning operation for the scanning duration ST which is about 1/60 second using (or utilizing) the clock signal CK and CKB which swings between a high level and a low level.

The clock signal CK and CKB maintains a set or predetermined low level for the non-scanning duration NST which is about 59/60 second. Thus, the power consumption of the display apparatus may be decreased for the non-scanning duration NST.

However, in the non-scanning duration NST, the gate driving circuit 300 does not generate the gate output signal GOUT and the carry signal CR. In a viewpoint of the N-th stage of the gate driving circuit 300, the (N+1)-th carry signal is not generated so that nodes that are pulled down in response to the (N+1)-th carry signal are not pulled down. For example, the voltage Q1(N) at the first node of the N-th stage may not be pulled down by the first pull-down part 361. For example, the gate output signal GOUT(N) of the N-th stage may not be pulled down by the second pull-down part 362. For example, the carry signal CR(N) of the N-th stage may not be pulled down by the carry pull-down part 370.

Due to the floated nodes, a level of the gate output signal GOUT(N) gradually increases. Thus, a switching element in the pixel of the display panel 100 may be slightly turned on so that a current may be leaked from a pixel electrode to the data line DL. Therefore, the reliability of the gate driver 300 may be reduced and the display quality of the display panel 100 may be deteriorated.

When the input image data RGB represents a video image, the reset signal RST constantly has a low level. Thus, the reset part 390 is not operated when the input image data RGB represents a video image.

When the input image data RGB represents a static image, the reset signal RST periodically increases to a high level from a low level. When the reset signal RST increases to the high level, the reset transistor of the reset part 390 is turned on so that the reset signal RST having the high level is applied to the inverting node Q3.

When the reset signal RST having the high level is applied to the inverting node Q3, the holding transistors T10, T10-1, T3, and T11 of the first holding part 381, the second holding part 382 and the third holding part 383.

When the first and second holding transistors T10 and T10-1 of the first holding part 381 are turned on, the voltage at the first node Q1(N) is pulled down to the second off voltage VSS2.

When the third holding transistor T3 of the second holding part 382 is turned on, the gate output signal GOUT(N) is pulled down to the first off voltage VSS1.

When the fourth holding transistor T11 of the third holding part 383 is turned on, the carry signal CR(N) is pulled down to the second off voltage VSS2.

The reset signal RST may be commonly applied to all of the stages of the gate driving circuit.

When the display panel 100 has the driving frequency of the first frequency corresponding to the input image data RGB representing a video image and the driving frequency of the second frequency corresponding to the input image data RGB representing a static image, the frequency of the reset signal RST may be equal to or greater than the second frequency and equal to or less than the first frequency. For example, when the first frequency is about 60 Hz and the second frequency is about 1 Hz, the frequency of the reset signal RST may be determined between about 1 Hz and about 60 Hz. When the reset signal RST has the frequency of about 2 Hz, the reset signal RST may have two pulses of the high level corresponding to the non-scanning duration NST in a second. When the reset signal RST has the frequency of about 10 Hz, the reset signal RST may have ten pulses of the high level corresponding to the non-scanning duration NST in a second.

According to the present example embodiment, when the input image data RGB represents a static image, the display panel 100 is driven in a low frequency so that the power consumption of the display apparatus may be reduced. When the display panel 100 is driven in a low frequency, the gate driver 300 periodically pulls down the gate output signal GOUT(N) using (or utilizing) the reset signal RST so that a false operation of the gate driver 300 may be prevented or substantially prevented. Thus, the reliability of the gate driver 300 and the display quality of the display panel 100 may be improved.

Figure 6:
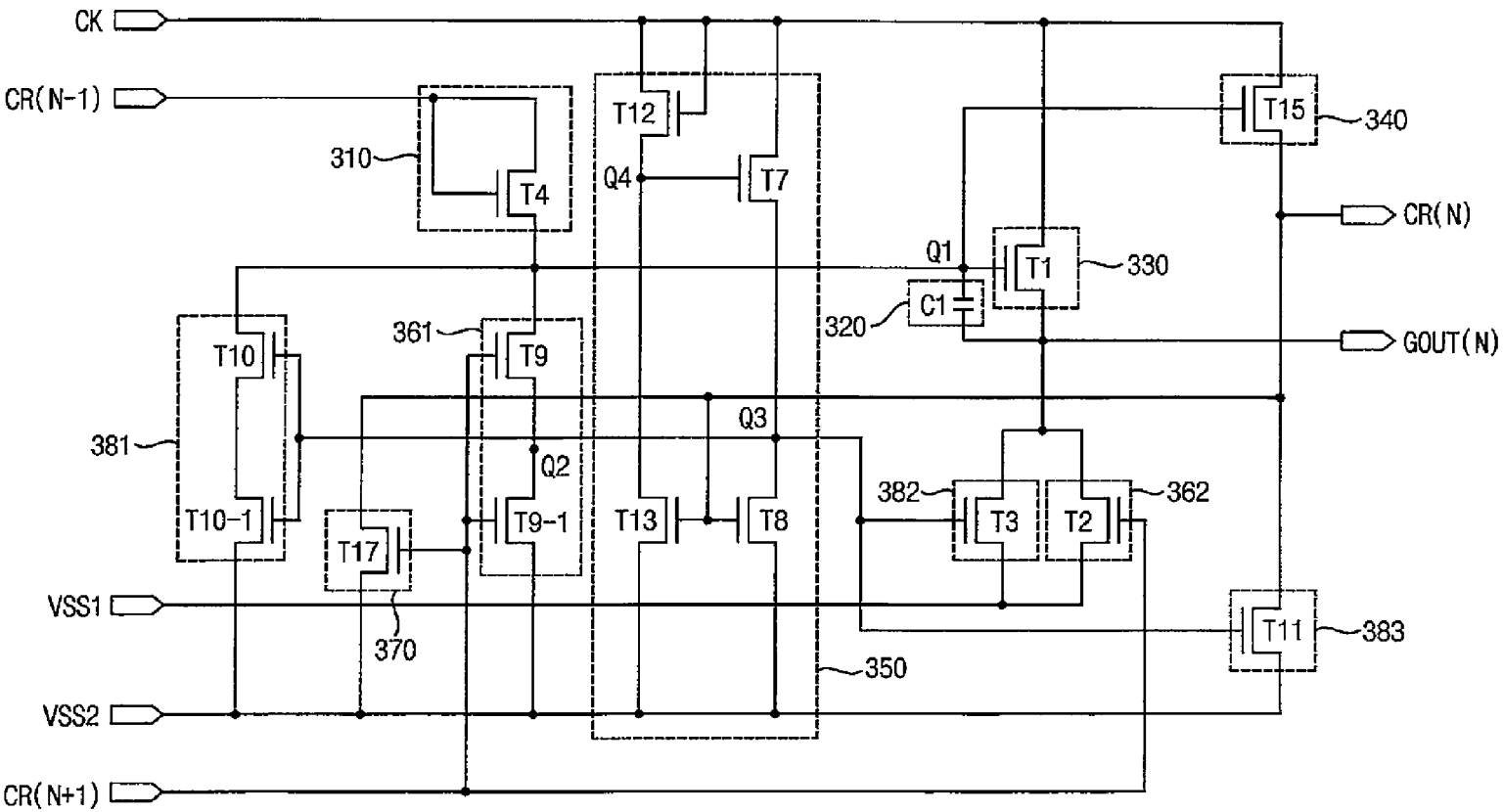
FIG. 6 is an equivalent circuit diagram illustrating an N-th stage of a gate driver according to an example embodiment of the present inventive concept.
Figure 7:
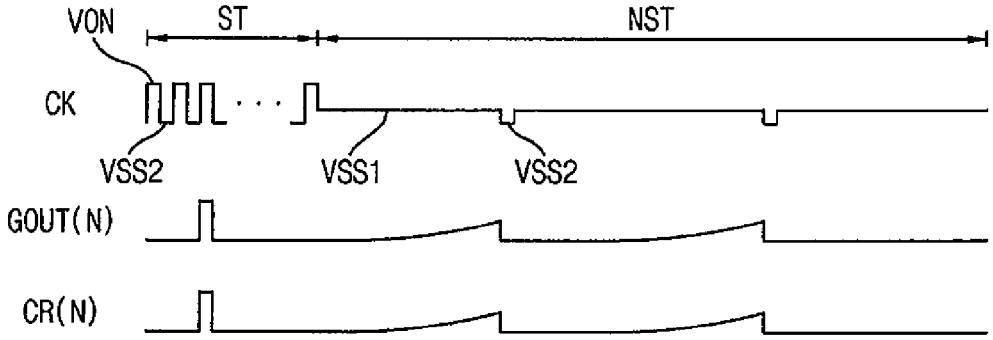
FIG. 7 is a waveform diagram illustrating input signals, node signals, and output signals of the N-th stage of the gate driver of FIG. 6 when the input image data represents a static image.

FIG. 6 is an equivalent circuit diagram illustrating an N-th stage of a gate driver according to an example embodiment of the present inventive concept. FIG. 7 is a waveform diagram illustrating input signals, node signals and output signals of the N-th stage of the gate driver of FIG. 6 when the input image data represents a static image.

The display apparatus according to the present example embodiment is substantially the same as the display apparatus of the previous example embodiment explained referring to FIGS. 1 to 5 except for a waveform of the clock signal CK and CKB and a structure of the gate driving circuit 300. Thus, the same reference numerals will be used to refer to the same or like parts as those described, in the previous example embodiment of FIGS. 1 to 5 and some repetitive explanation concerning the above elements will be omitted.

Referring to FIGS. 1, 3, 4, 6, and 7, the display apparatus includes a display panel 100 and a panel driver. The panel driver includes a timing controller 200, a gate driver 300, a gamma reference voltage generator 400, and a data driver 500.

The gate driver 300 receives a first clock signal CK, a second clock signal CKB, a first off voltage VSS1, a second off voltage VSS2, and a reset signal RST. The gate driver 300 outputs a gate output signal GOUT.

The N-th stage outputs an N-th gate output signal GOUT (N) and an N-th carry signal CR(N) in response to an (N−1)-th carry signal CR(N−1) of an (N−1)-th stage, which is a previous stage of the N-th stage. The N-th stage pulls down the N-th gate output signal GOUT(N) to the first off voltage VSS1 in response to an (N+1)-th carry signal CR(N+1) of an (N+1)-th stage, which is a next stage of the N-th stage.

In a similar manner, first to last stages sequentially output gate output signals GOUT.

The n-th stage includes a pull-up control part 310, a charging part 320, a pull-up part 330, a carry part 340, an inverting part 350, a first pull-down part 361, a second pull-down part 362, a carry pull-down part 370, a first holding part 381, a second holding part 382, and a third holding part 383.

The timing controller 200 determines whether the input image data RGB represents a static image or a video image.

When the input image RGB represents a video image, the timing controller 200 sets the driving frequency of the display panel 100 to a first frequency. When the input image RGB represents a static image, the timing controller 200 sets the driving frequency of the display panel 100 to a second frequency. The second frequency is less than the first frequency.

When the display panel 100 is driven in a high frequency, each of the clock signals CK and CKB swings between a high level and a low level and the gate driving circuit 300 repeats a scanning operation.

In contrast, when the display panel 100 is driven in a low frequency, the gate driving circuit 300 operates a scanning operation for a short scanning duration ST and stops scanning for a long non-scanning duration NST.

In the present example embodiment, when the input image data RGB represents a static image, the clock signal CK swings between a high level and a low level for a scanning duration ST and the clock signal CK maintains a first low level and periodically decreases to a second low level from the first low level for a non-scanning duration NST.

In the present example embodiment, the first low level may be substantially the same as the first off voltage VSS1. The second low level may be substantially the same as the second off voltage VSS2.

In the non-scanning duration NST, the gate driving circuit 300 does not generate the gate output signal GOUT and the carry signal CR. In a viewpoint of the N-th stage of the gate driving circuit 300, the (N+1)-th carry signal is not generated so that nodes which are pulled down in response to the (N+1)-th carry signal are not pulled down.

Due to the floated nodes, a level of the gate output signal GOUT(N) gradually increases. Thus, a switching element in the pixel of the display panel 100 may be slightly turned on so that a current may be leaked from a pixel electrode to the data line DL. Therefore, the reliability of the gate driver 300 may be reduced and the display quality of the display panel 100 may be deteriorated.

When the input image data RGB represents a static image, the clock signal CK maintains the first low level and periodically decreases to the second low level from the first low level.

When the clock signal CK decreases to the second low level, a current flows from the gate output terminal to the clock terminal due to a drain-source voltage Vds of the first transistor T1 so that the level of the gate output signal GOUT(N) may decrease.

In addition, when the clock signal CK decreases to the second low level, a current flows from the carry terminal to the clock terminal due to a drain-source voltage Vds of the fifteenth transistor T15 so that the level of the carry signal CR(N) may decrease.

When the display panel 100 has the driving frequency of the first frequency corresponding to the input image data RGB representing a video image and the driving frequency of the second frequency corresponding to the input image data RGB representing a static image, the frequencies of each of the clock signals CK and CKB to decrease to the second low level may be equal to or greater than the second frequency and equal to or less than the first frequency. For example, when the first frequency is about 60 Hz and the second frequency is about 1 Hz, the frequencies of each of the clock signals CK and CKB to decrease to the second low level may be determined to be between about 1 Hz and about 60 Hz. When the frequencies of the clock signals CK and CKB to decrease to the second low level is about 2 Hz, the frequencies of the clock signals CK and CKB may have two pulses of the second low level corresponding to the non-scanning duration NST in a second. When the frequencies of the clock signals CK and CKB to decrease to the second low level is about 10 Hz, the frequencies of the clock signals CK and CKB may have ten pulses of the second low level corresponding to the non-scanning duration NST in a second.

According to the present example embodiment, when the input image data RGB represents a static image, the display panel 100 is driven in a low frequency so that the power consumption of the display apparatus may be reduced. When the display panel 100 is driven in a low frequency, the gate driver 300 periodically pulls down the gate output signal GOUT(N) using (or utilizing) the clock signals CK and CKB so that a false operation of the gate driver 300 may be prevented or substantially prevented. Thus, the reliability of the gate driver 300 and the display quality of the display panel 100 may be improved.

Figure 8:
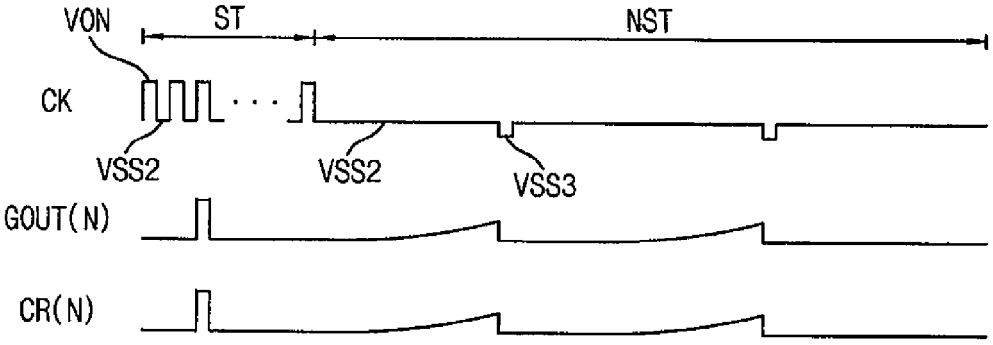
FIG. 8 is a waveform diagram illustrating input signals, node signals, and output signals of the N-th stage of a gate driver according to an example embodiment of the present inventive concept when the input image data represents a static image.

FIG. 8 is a waveform diagram illustrating input signals, node signals and output signals of the N-th stage of a gate driver 300 according to an example embodiment of the present inventive concept when input image data represents a static image.

The display apparatus according to the present example embodiment is substantially the same as the display apparatus of the previous example embodiment explained referring to FIGS. 6 and 7 except for a waveform of the clock signals CK and CKB. Thus, the same reference numerals will be used to refer to the same or like parts as those described in the previous example embodiment of FIGS. 6 and 7 and some repetitive explanation concerning the above elements will be omitted.

Referring to FIGS. 1, 3, 4, 6, and 8, the display apparatus includes a display panel 100 and a panel driver. The panel driver includes a timing controller 200, a gate driver 300, a gamma reference voltage generator 400 and a data driver 500.

The gate driver 300 receives a first clock signal CK, a second clock signal CKB, a first off voltage VSS1, a second off voltage VSS2, and a reset signal RST. The gate driver 300 outputs a gate output signal GOUT.

The N-th stage outputs an N-th gate output signal GOUT (N) and an N-th carry signal CR(N) in response to an (N−1)-th carry signal CR(N−1) of an (N−1)-th stage, which is a previous stage of the N-th stage. The N-th stage pulls down the N-th gate output signal GOUT(N) to the first off voltage VSS1 in response.to an (N+1)-th carry signal CR(N+1) of an (N+1)-th stage, which is a next stage of the N-th stage.

In a similar manner, first to last stages sequentially outputs gate output signals GOUT.

The n-th stage includes a pull-up control part 310, a charging part 320, a pull-up part 330, a carry part 340, an inverting part 350, a first pull-down part 361, a second pull-down part 362, a carry pull-down part 370, a first holding part 381, a second holding part 382, and a third holding part 383.

The timing controller 200 determines whether the input image data RGB represents a static image or a video image.

When the input image RGB represents a video image, the timing controller 200 sets the driving frequency of the display panel 100 to a first frequency. When the input image RGB represents a static image, the timing controller 200 sets the driving frequency of the display panel 100 to a second frequency. The second frequency is less than the first frequency.

When the display panel 100 is driven in a high frequency, the clock signal CK and CKB swings between a high level and a low level and the gate driving circuit 300 repeats a scanning operation.

In contrast, when the display panel 100 is driven in a low frequency, the gate driving circuit 300 operates a scanning operation for a short scanning duration ST and stops scanning for a long non-scanning duration NST.

In the present example embodiment, when the input image data RGB represents a static image, the clock signal CK swings between a high level and a low level for a scanning duration ST and the clock signal CK maintains a first low level and periodically decreases to a second low level from the first low level for a non-scanning duration NST.

In the present example embodiment, the first low level may be substantially the same as the second off voltage VSS2. The second low level may be substantially the same as a third off voltage VSS3 which is less than the second off voltage VSS2.

In the non-scanning duration NST, the gate driving circuit 300 does not generate the gate output signal GOUT and the carry signal CR. In a viewpoint of the N-th stage of the gate driving circuit 300, the (N+1)-th carry signal is not generated so that nodes which are pulled down in response to the (N+1)-th carry signal are not pulled down.

Due to the floated nodes, a level of the gate output signal GOUT(N) gradually increases. Thus, a switching element in the pixel of the display panel 100 may be slightly turned on so that a current may be leaked from a pixel electrode to the data line DL. Therefore, the reliability of the gate driver 300 may be reduced and the display quality of the display panel 100 may be deteriorated.

When the input image data RGB represents a static image, the clock signal CK maintains the first low level and periodically decreases to the second low level from the first low level.

When the clock signal CK decreases to the second low level, a current flows from the gate output terminal to the clock terminal due to a drain-source voltage Vds of the first transistor T1 so that the level of the gate output signal GOUT(N) may decrease.

In addition, when the clock signal CK decreases to the second low level, a current flows from the carry terminal to the clock terminal due to a drain-source voltage Vds of the fifteenth transistor T15 so that the level of the carry signal CR(N) may decrease.

According to the present example embodiment, when the input image data

RGB represents a static image, the display panel 100 is driven in a low frequency so that the power consumption of the display apparatus may be reduced. When the display panel 100 is driven in a low frequency, the gate driver 300 periodically pulls down the gate output signal GOUT(N) using (or utilizing) the clock signals CK and CKB so that a false operation of the gate driver 300 may be prevented or substantially prevented.

Thus, the reliability of the gate driver 300 and the display quality of the display panel 100 may be improved.

According to the present inventive concept as explained above, a power consumption of the display apparatus may be reduced, a reliability of the gate driving circuit may be improved and a display quality of the display panel may be improved.

The foregoing is illustrative of the present inventive concept and is not to be construed as limiting thereof. Although a few example embodiments of the present inventive concept have been described, those skilled in the art will readily appreciate that many modifications are possible in the example embodiments without materially departing from the novel teachings and aspects of the present inventive concept.

Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific example embodiments disclosed, and that modifications to the disclosed example embodiments, as well as other example embodiments, are intended to be included within the scope of the appended claims. The present inventive concept is defined by the following claims, with equivalents of the claims to be included therein.

What is claimed is:

1. A gate driving circuit comprising:

a pull-up control part configured to apply a carry signal of one of previous stages to a first node;

a pull-up part configured to output a clock signal as an N-th gate output signal in response to a signal applied to the first node;

a carry part configured to output the clock signal as an N-th carry signal in response to the signal applied to the first node;

a first pull-down part configured to pull down the signal at the first node to a second off voltage in response to a carry signal of one of next stages;

a second pull-down part configured to pull down the N-th gate output signal to a first off voltage in response to the carry signal of the one of the next stages;

an inverting part configured to generate an inverting signal based on the clock signal and the second off voltage to output the inverting signal to an inverting node; and a reset part configured to output a reset signal to the inverting node, wherein N is a positive integer.

2. The gate driving circuit of claim 1, wherein when input image data represents a video image, the reset signal has a low level, and when the input image data represents a static image, the reset signal periodically increases to a high level from the low level.

3. The gate driving circuit of claim 2, wherein the reset signal is commonly applied to all of stages of the gate driving circuit.

4. The gate driving circuit of claim 3, wherein when the input image data represents the video image, a display panel has a first driving frequency, when the input image data represents the static image, the display panel has a second driving frequency less than the first driving frequency, and a frequency of the reset signal is equal to or greater than the second driving frequency and equal to or less than the first driving frequency.

5. The gate driving circuit of claim 1, wherein the reset part comprises a reset transistor, and the reset transistor comprises a control electrode and an input electrode commonly coupled to a reset terminal to which the reset signal is applied and an output electrode coupled to the inverting node.

6. The gate driving circuit of claim 5, further comprising a first holding part configured to pull down the signal at the first node to the second off voltage in response to the inverting signal applied to the inverting node and the reset signal, wherein the first holding part comprises a first holding transistor and a second holding transistor coupled to each other in series, wherein the first holding transistor comprises a control electrode coupled to the inverting node, an input electrode coupled to the first node, and an output electrode coupled to an input electrode of the second holding transistor, and wherein the second holding transistor comprises a control electrode coupled to the inverting node, the input electrode coupled to the output electrode of the first holding transistor, and an output electrode to which the second off voltage is applied.

7. The gate driving circuit of claim 6, further comprising a second holding part configured to pull down the N-th gate output signal to the-first off voltage in response to the inverting signal and the reset signal, wherein the second holding part comprises a third holding transistor, and wherein the third holding transistor comprises a control electrode coupled to the inverting node, an input electrode coupled to a terminal outputting the N-th gate output signal, and an output electrode to which the first off voltage is applied.

8. The gate driving circuit of claim 7, further comprising a third holding part configured to pull down the N-th carry signal to the second off voltage in response to the inverting signal and the reset signal, wherein the third holding part comprises a fourth holding transistor, and wherein the fourth holding transistor comprises a control electrode coupled to the inverting node, an input electrode coupled to a terminal outputting the N-th carry signal, and an output electrode to which the second off voltage is applied.

9. The gate driving circuit of claim 1, wherein the inverting part comprises:

a first inverting transistor and a third inverting transistor coupled to each other in series, and a second inverting transistor and a fourth inverting-transistor coupled to each other in series.

10. The gate driving circuit of claim 9, wherein the first inverting transistor comprises a control electrode and an input electrode to which the clock signal is commonly applied and an output electrode coupled to a fourth electrode, wherein the second inverting transistor comprises a control electrode coupled to a fourth node, an input electrode to which the clock signal is applied, and an output electrode coupled to the inverting node, wherein the third inverting transistor comprises a control electrode coupled to a terminal outputting the N-th carry signal, an input electrode coupled to the fourth node, and an output electrode to which the second off voltage is applied, and wherein the fourth inverting transistor comprises a control electrode coupled to the terminal outputting the N-th carry signal, an input electrode coupled to the inverting node, and an output electrode to which the second off voltage is applied.

11. The gate driving circuit of claim 10, wherein the inverting signal has a high level when the clock signal has a high level, the inverting signal has a low level when the clock signal has a low level, and the inverting signal has the low level when the N-th carry signal has a high level.

12. The gate driving circuit of claim 1, further comprising a carry pull-down part configured to pull down the N-th carry signal to the second off voltage in response to the carry signal of one of the next stages.

13. A gate driving circuit comprising:

a pull-up control part configured to apply a carry signal of one of previous stages to a first node;

a pull-up part configured to output a clock signal as an N-th gate output signal in response to a signal applied to the first node;

a carry part configured to output the clock signal as an N-th carry signal in response to the signal applied to the first node;

a first pull-down part configured to pull down the signal at the first node to a second off voltage in response to a carry signal of one of next stages;

a second pull-down part configured to pull down the N-th gate output signal to a first off voltage in response to the carry signal of the one of the next stages; and an inverting part configured to generate an inverting signal based on the clock signal and the second off voltage to output the inverting signal to an inverting node, wherein when input image data represents a video image, the clock signal swings between a high level and a low level, wherein when the input image data represents a static image, the clock signal swings between the high level and the low level for a scanning duration and the clock signal maintains a first low level and periodically decreases to a second low level from the first low level for a non-scanning duration, and wherein N is a positive integer.

14. The gate driving circuit of claim 13, wherein the first low level is the first off voltage, and the second low level is the second off voltage.

15. The gate driving circuit of claim 13, wherein the first low level is the second off voltage, and the second low level is a third off voltage less than the second off voltage.

16. The gate driving circuit of claim 13, wherein when the input image data represents the video image, a display panel has a driving frequency of a first frequency, wherein when the input image data represents the static image, the display panel has the driving frequency of a second frequency less than the first frequency, and wherein a frequency of the clock signal to decrease to the second low level in the non-scanning duration is equal to or greater than the second frequency and equal to or less than the first frequency.

17. A display apparatus comprising:

a display panel configured to display an image;

a data driving circuit configured to apply a data voltage to the display panel; and a gate driving circuit configured to apply a gate output signal to the display panel, the gate driving circuit comprising:

a pull-up control part configured to apply a carry signal of one of previous stages to a first node;

a pull-up part configured to output a clock signal as an N-th gate output signal in response to a signal applied to the first node;

a carry part configured to output the clock signal as an N-th carry signal in response to the signal applied to the first node;

a first pull-down part configured to pull down the signal at the first node to a second off voltage in response to a carry signal of one of next stages;

a second pull-down part configured to pull down the N-th gate output signal to a first off voltage in response to the carry signal of the one of the next stages;

an inverting part configured to generate an inverting signal based on the clock signal and the second off voltage to output the inverting signal to an inverting node; and a reset part configured to output a reset signal to the inverting node, wherein N is a positive integer.

18. The display apparatus of claim 17, wherein when input image data represents a video image, the reset signal has a low level, and when the input image data represents a static image, the reset signal periodically increases to a high level from the low level.

19. The display apparatus of claim 18, wherein the reset signal is commonly applied to all of stages of the gate driving circuit.

20. The display apparatus of claim 17, wherein the reset part comprises a reset transistor, and the reset transistor comprises a control electrode and an input electrode commonly coupled to a reset terminal to which the reset signal is applied and an output electrode coupled to the inverting node.

* * * * *